US007897212B2

(12) United States Patent
Kurittu

(10) Patent No.: US 7,897,212 B2
(45) Date of Patent: Mar. 1, 2011

(54) METHOD OF MARKING MATERIAL, MARKED AND VERIFICATION OF GENUINENESS OF A PRODUCT

(75) Inventor: Minna Kurittu, Pori (FI)

(73) Assignee: Stora Enso Oyj, Helsinki (FI)

( * ) Notice: Subject to any disclaimer, the term of this patent is extended or adjusted under 35 U.S.C. 154(b) by 267 days.

(21) Appl. No.: 11/662,086

(22) PCT Filed: Sep. 9, 2005

(86) PCT No.: PCT/FI2005/000389

§ 371 (c)(1),
(2), (4) Date: Mar. 7, 2007

(87) PCT Pub. No.: WO2006/027418

PCT Pub. Date: Mar. 16, 2006

(65) Prior Publication Data

US 2008/0187851 A1 Aug. 7, 2008

(30) Foreign Application Priority Data

Sep. 10, 2004 (FI) ..... 20041177

(51) Int. Cl.
*B05D 5/00* (2006.01)

(52) U.S. Cl. ..... 427/256; 250/372; 250/458.1; 250/461.1; 427/7; 427/158; 427/283

(58) Field of Classification Search ..... 427/256, 427/7, 158, 283
See application file for complete search history.

(56) References Cited

U.S. PATENT DOCUMENTS 4,657,807 A * 4/1987 Fuerstman ..... 442/230
4,740,269 A 4/1988 Berger et al.
5,347,293 A * 9/1994 Wiedemann et al. ..... 345/87
6,168,853 B1 * 1/2001 Feng et al. ..... 428/207

(Continued)

FOREIGN PATENT DOCUMENTS

DE 34 15 441 A1 10/1985

(Continued)

OTHER PUBLICATIONS

Nordström et al., Tappi proceedings, 1997 Coating Conference, pp. 265-277.

(Continued)

*Primary Examiner*—Michael Kornakov
*Assistant Examiner*—Xiao Zhao
(74) *Attorney, Agent, or Firm*—Birch, Stewart, Kolasch & Birch, LLP

(57) ABSTRACT

The invention relates to the marking of a material (18) with identifier marks (16), the material thus marked, and verification of the genuineness of a product on the basis of the marks. In accordance with the invention, an optical brightener is incorporated in the material (18), and marking is performed by reducing the brightness of the material at a selected location by directing local heating to this location, the mark (16) thus produced appearing with a darker shade than its environment in ultraviolet light (20). The marking is based on partial or complete destruction of the brightening effect of the optical brightener under heating. The invention is suitable for providing e.g. coated paper and board containing an optical brightener with identifier marks for preventing falsifications.

15 Claims, 3 Drawing Sheets

U.S. PATENT DOCUMENTS

Figure 1:
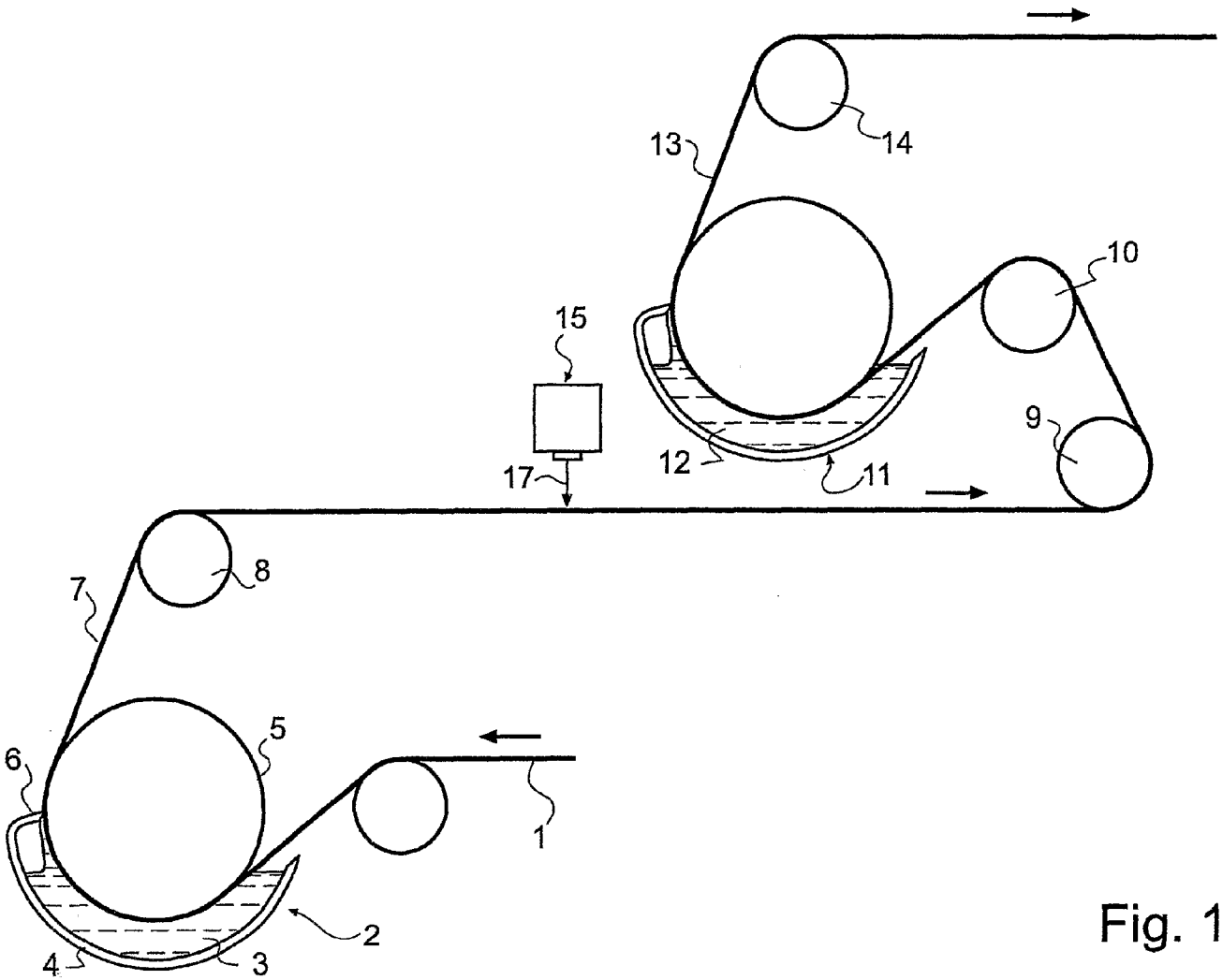

| | | | | |
|---|---|---|---|---|
| 2002/0122931 | A1 | 9/2002 | Brownfield et al. | |
| 2003/0039904 | A1* | 2/2003 | Camp et al. | 430/11 |
| 2004/0027514 | A1* | 2/2004 | Kobayashi et al. | 349/110 |

FOREIGN PATENT DOCUMENTS

| | | | |
|---|---|---|---|
| DE | 41 14 732 | A1 | 11/1992 |
| DE | 199 36 030 | A1 | 2/2001 |
| DE | 101 22 528 | A1 | 11/2002 |
| GB | 2 234 601 | A | 2/1991 |
| WO | WO 90/06539 | A1 | 6/1990 |
| WO | WO 98/36913 | A1 | 8/1998 |
| WO | WO-01/98588 | A1 | 12/2001 |

OTHER PUBLICATIONS

Supplementary European Search Report issued on May 17, 2010 for application No. 05786191.6.

* cited by examiner

METHOD OF MARKING MATERIAL, MARKED AND VERIFICATION OF GENUINENESS OF A PRODUCT

The invention relates to a method for marking a material and to the marked material that can be manufactured by this method. The invention further relates to a method for verifying the genuineness of the product based on the use of said marked material.

At the packaging stage, consumer packages can be provided with visible marks with the purpose to inform consumers e.g. of the packaging date or best-before date of the product. In addition, partially or completely invisible marks can be made to serve as product identifiers identifying the origin or confirming the authenticity of the product.

Known methods of marking products comprise prints with printing ink as well as punches, indentations or perforations made in the packaging material by pressing or cutting. Packages are nowadays increasingly marked by laser, whereby the marks are made by laser beam techniques without physical contact with the packaging material and without applying printing ink or any such extra material.

U.S. Pat. No. 6,306,493 describes paper or board to be marked by laser, comprising doped finely divided polymer, which carbonises under the effect of the laser beam, thus leaving a distinctive dark trace at the location of the mark. Such a paper or board is intended as the packaging material of consumer packages, labels or wrapping paper, which are marked in the course of the packaging process.

U.S. Pat. No. 5,340,628 describes a layered packaging material to be marked by laser, in which a polymer layer has been applied to the paper base, the laser beam penetrating through the polymer layer and leaving a marking trace in the subjacent paper layer. The material is intended as labels to be affixed to product packages, in which the laser marks contain package-specific information about the packaged product.

As stated above, the materials and techniques described in the references above are primarily intended for consumer indications made at the packaging stage of the product. They are less apt as identifiers indicating the authenticity of the product and intended to prevent or impede counterfeits. For this purpose, the best marks are such that are invisible to the naked eye and that are preferably located in an inner layer of a multi-layer material for increased safety.

To avoid counterfeits, identifier marks are thus preferably made as a process integrated in the manufacture of the product or the packaging material. Such a mark that reoccurs in the product and its package will associate the product with its manufacturer.

By using an optical brightener, one can achieve marks in a material that are invisible in normal illumination. Typical optical brighteners comprise stilbene derivatives, such as e.g. derivatives of disulphonic acid of diamino stilbene used in the paper industry and derivatives of bistriazinyl stilbene. The operation of brighteners is based on fluorescence, signifying that they absorb invisible ultraviolet radiation from daylight and transform it into a visible, mainly blue and violet light. Used as a component in a paper coating paste, optical brighteners increase the brightness of paper. Known identifier marks based on optical brighteners are based on the fact that they appear more brightly than their environment when exposed to UV irradiation.

U.S. Pat. No. 4,725,078 discloses a gypsum wall panel marked as described above, with the mark protected under a layer of paint. The reference states that the mark can be revealed, if desired, by removing the paint and by exposing it to UV light. U.S. Pat. No. 4,257,692, in turn, discloses a lens made of organic material and marked with a substance containing an optical brightener. The mark is visible in UV illumination alone.

The article Nordström J-E. P. et al, TAPPI proceedings, 1997 Coating Conference, pp. 265-277 examines the effects of heat and moisture on an optical brightener used in papers and boards. The article states that heating destroys the effect of the optical brightener, given the reduced brightness of paper coating starting during surface heating in the temperature range 110-120° C. A strong decrease in brightness was noted in the temperature range approx. 140-160° C. during oven heating. Loss of the brightener effect is, of course, detrimental in the paper industry, and thus this article is relevant to those skilled in the art in providing information about the precautions to take in order to avoid harmful effects in the production process.

The known marking methods based on the use of an optical brightener mentioned above have the drawback of producing a mark containing a brightener by a coating or any similar material transfer, requiring the material containing the brightener to be applied to the marked location in a configuration corresponding to the desired mark, e.g. in the form of a text, number series, logo or similar pattern. The invention thus has the purpose of providing a solution for substantially simplified marking. The invention is particularly advantageous for marking materials normally containing an optical brightener; coated paper and board products are examples of such materials.

The method of the invention for marking a material is primarily characterised by including an optical brightener in the material and by carrying out the marking by reducing the brightness of the material at a selected location by exposing this location to local heating, resulting in a mark that appears with a darker shade than its environment in ultraviolet light.

In other words, the invention utilises the optical brightener incorporated in the material or the product comprising it, the optical brightener having perhaps been added for brightness of the material or similar matters of appearance, by destroying the effect of the brightener in a limited area corresponding to the mark, the mark consisting most typically of a logo or a similar emblem pattern, a product or company name, a number or character symbol or the like. Given the small mark area relative to the overall area of the material or product, the resulting local brightness decrease is not visible to the naked eye in the practice, but the material appears to have even and flawless colour. By contrast, with the material placed in UV light, one can immediately observe reduced or disappeared brightness at the marks, and then the mark is sharply distinctive in a darker shade than its environment.

The chief advantage of the invention is that the marking utilises a component pre-viously incorporated in the material, so that no material transfer to exactly defined areas is required, such as is characteristic of prior art methods. The method is easier to carry out by irradiation for heating the material, such as a laser beam directed to the marked location, the absorptive heat of the laser beam destroying locally the brightener effect required for the mark. Optionally, marking can be performed by applying a heating element operating as a stamp on the material, and then the points of contact between the element and the material surface result in a marking trace by destroying the brightener effect at these particular locations.

The invention is particularly well applicable to the marking of identifiers in paper and board products. An optical brightener is a commonly used component in such products, it may e.g. be incorporated in a coating paste. Marking can be performed on a moving continuous web during the manufacture of paper or board or during product processing. The marked product may thus be a web-like wrapped paper or board, a sheet cut from a web, any other paper or board product with given dimensions, a package blank or a package formed from a blank.

In accordance with the invention, a layered material can be marked during its manufacture by marking a material layer containing an optical brightener and by applying a second material layer on top of this layer, with the marks remaining within the layer structure produced. This idea is applicable to paper or board production e.g. by applying a precoating layer containing an optical brightener onto a moving paper or board web, by marking the precoating layer, and by applying a surface coating onto the web thus precoated and marked, whereby the marks are protected under the surface coating. The marking can be performed using a laser beam on a continuously moving web in a paper or board machine. Optionally, the marks can be made on a surface coating containing an optical brightener, and the surface coating can be further coated with a polymer coating so that the marks will be protected under the polymer layer.

The material of the invention that has been marked as described above is characterised by the material containing doped optical brightener and by the material being marked by local reduction of its brightness, so that the mark appears with a darker shade than its environment in ultraviolet light. Special examples of the product of the invention include paper or board, whose identifier marks are located in a pre-coating layer containing an optical brightener under the surface coating. The method of the invention for verifying the authenticity of a product is characterised by incorporating a material in the product in which an optical brightener has been dispersed and which has been marked by reducing its brightness at a selected location by means of locally directed heating, and by exposing the product to ultraviolet light for exposing the identifier mark. Products under consideration comprise e.g. product packages made of paper or board and documents and similar printed matter made of paper.

Figure 2:
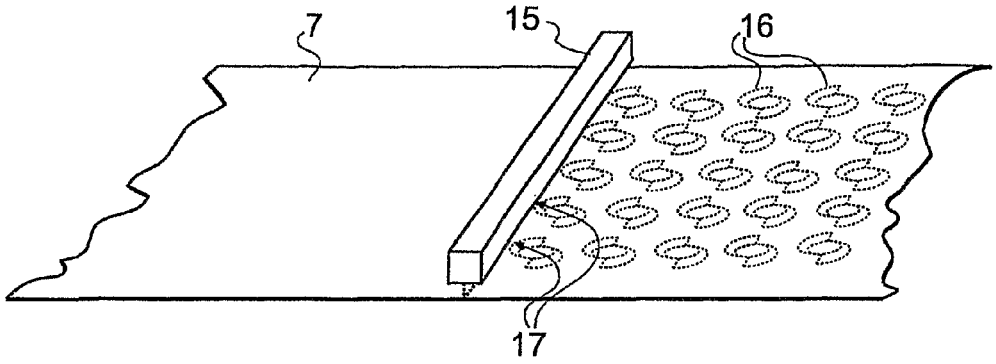
Figure 3:
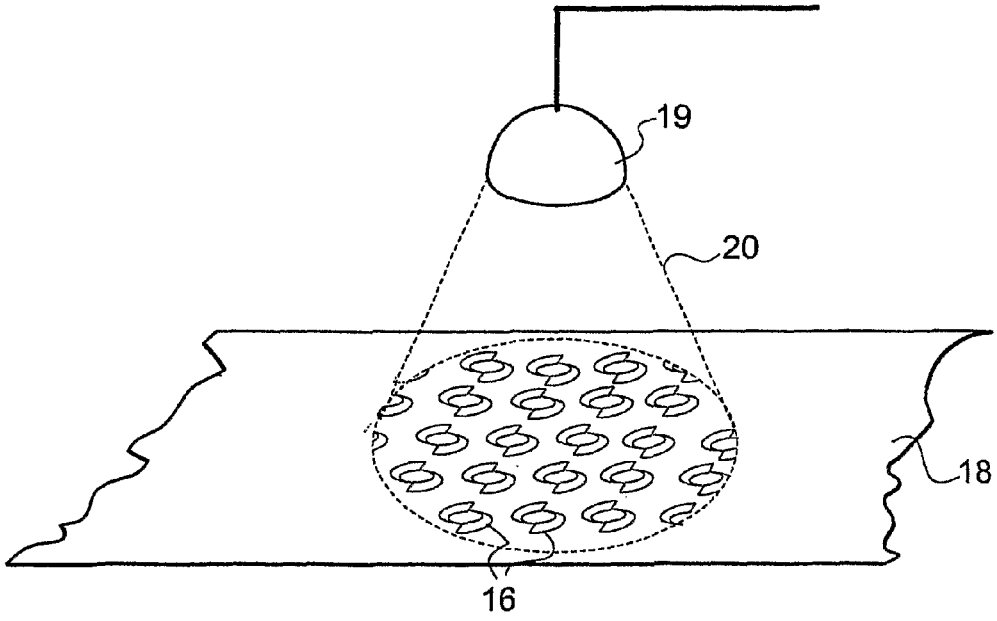

The invention is explained in greater detail below by means of an example and with reference to the accompanying drawings, in which FIG. 1 illustrates a process for producing a coated board, in which a precoating is laser marked and subsequently coated with a surface coating, FIG. 2 illustrates the marking step of the process of FIG. 1, in which the marks are produced by acting on the optical brightener included in the precoating with a laser beam, FIG. 3 illustrates a sheet cut from a finished coated board in UV light bringing out the marks.

Figure 4:
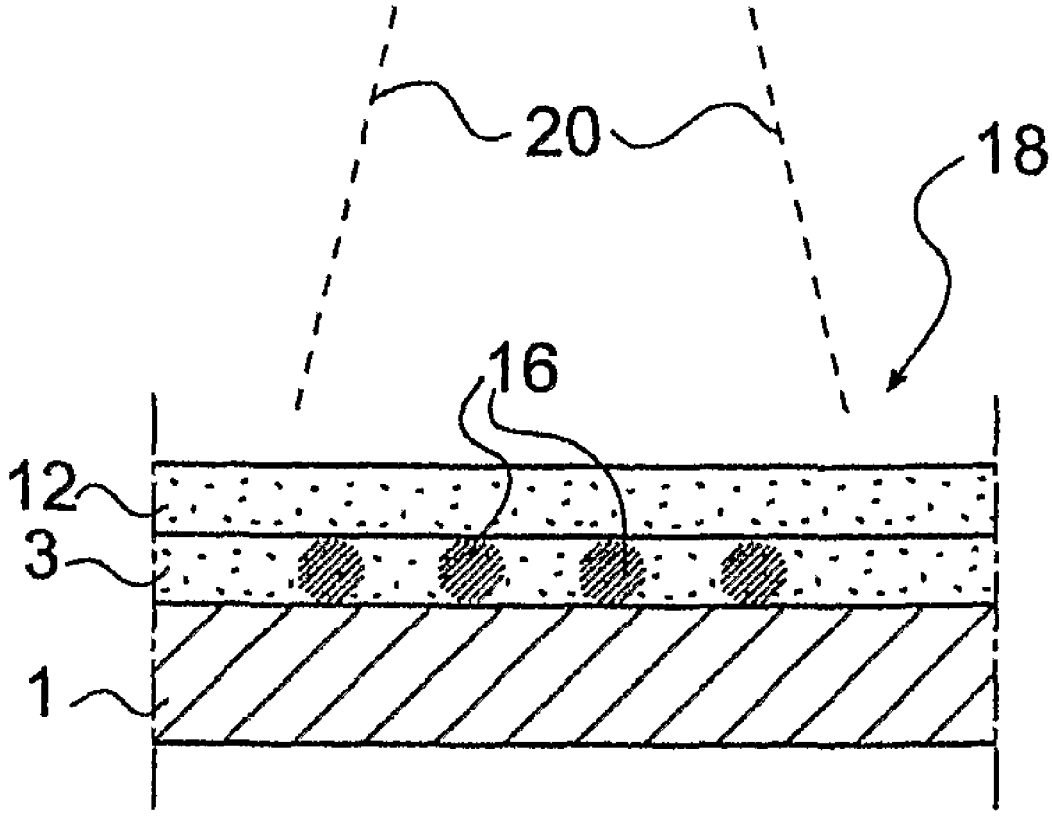

FIG. 4 is a section from the layer structure of a coated board at the marks.

In the process of FIG. 1, a board web 1 is coated in two successive steps by leading it first to a precoating unit 2, where the web is taken to a basin 4 containing a precoating agent 3 under the control of a roll 5 and the thickness of the precoating layer thus produced is adjusted with a coating blade 6. The precoated web 7 is taken over a drier roll 8 and transferred over guide rolls 9, 10 to a precoating unit 11, whose construction and operation correspond to those of precoating unit 2. The web that has been precoated in surface coating unit 11 receives a precoating layer 12, whose thickness is adjusted with a coating blade. The double-coated web 13 thus obtained continues over a drier roll 14 to be rolled as a finished coated board or for further processing, such as e.g. to be cut into sheets of given dimensions.

After the precoating steps, a beam 15 transverse to the web has been placed on the path of the web 7 as shown in FIGS. 1 and 2, the beam comprising laser heads for making identifier marks 16 with a laser beam 17 in the precoating layer. In accordance with the invention, marking is based on an optical brightener incorporated in the precoating paste 3, the brightener increasing the brightness of the coated product in daylight by converting ultraviolet beams to visible light. The pre-coating layer thus contains an optical brightener in a specific concentration and evenly distributed in the layer. The laser beam 17 acts on locations at given intervals in the continuously moving web 7, where the beam is absorbed into the coating paste and under heat destroys the brightening effect obtained with the optical brightener partly or completely. In FIG. 2, the marks 16 are repeated symbol patterns indicated with dotted lines in the figure. Since the lines forming the patterns are relatively thin and since their proportion of the overall area of the web 7 is small, they are not visible with the naked eye in daylight. In addition, in the process described, they end under the surface coating layer applied to the precoated web 7 in the following step.

FIGS. 3 and 4 illustrate a finished coated board and identifier marks 16 incorporated in accordance with the invention. FIG. 3 shows a sheet 18 cut from a board and FIG. 4 its layer structure. The coated board consists of a base board 1, of a precoating layer 3 on top of this and of an uppermost surface coating layer 12. The identifier marks 16 produced as described above are included in the pre-coating layer 3.

In normal light, such as daylight, a board coated in accordance with the invention has an evenly light shade. The identifier marks 16 are not visible with the naked eye. By contrast, with the board placed in ultraviolet light, the identifier marks 16 strongly appear darker than their environment in the area illuminated by the beams 20 of a UV lamp 19. In UV light 20, the optical brightener contained in the precoating 3 transforms the UV radiation to visible light so that the surface appears strongly illuminated. However, this phenomenon does not occur at the identifier marks 16, where the action of the optical brightener has been partly or totally destroyed in the marking step. The marks 16 thus appear darker to the human eye than their environment.

It is obvious to those skilled in the art that the invention is applicable in many other ways in addition to those described above. Thus, for instance, the identifier marks can be made on the surface coating layer 12, instead of the precoating layer 3, either in the board production process or later, when the board is used for product packages, for instance. It is also possible to provide a board coated with coating paste and marked in accordance with the invention with a transparent polymer coating after the marking step. Instead of laser irradiation, marks can be produced by using a heating element, which is brought into direct contact with the material to be marked, such as the surface of a precoated or surface-coated board. Such an element could consist e.g. of a heated roll placed on the path of the web and equipped with relief patterns corresponding to the marks. The material to be marked is not necessarily a coated paper or board, because the invention is applicable to the marking of any products containing an optical brightener, provided that the material can be locally heated without altering or damaging it, except for the marks.

EMBODIMENT EXAMPLES

In a test array, the board was coated with different precoating pastes (samples 1-6), whose compositions and parameters are given in table 1. The amount of pre-coating layer was 10 $g/m^2$ in each case. After drying of the precoating, the samples were marked with a Cynrad Fenix 25 W $CO_2$-laser directed to the precoating at a wavelength of 1064 nm. Then the precoated and marked samples were coated with a surface coating paste, whose composition and parameters are given in table 2. The amount of precoating layer was 10 g/m$^2$ in each case.

TABLE 1

| precoatings | | | | | | |
|---|---|---|---|---|---|---|
| | Sample | | | | | |
| | 1 | 2 | 3 | 4 | 5 | 6 |
| Ground $CaCO_3$[1] | 100 | | | | | |
| Kaolin[2] | | 100 | | | | |
| Precipitated $CaCO_3$[3] | | | 100 | | | |
| $TiO_2$, anatase[4] | | | | 100 | | |
| $TiO_2$, rutile[5] | | | | | 100 | |
| Gypsum[6] | | | | | | 100 |
| Dispersing agent[7] | 0.2 | 0.2 | 0.2 | 0.2 | 0.2 | 0.2 |
| Polyvinyl alcohol[8] | 0.14 | 0.14 | 0.14 | 0.14 | 0.14 | 0.14 |
| Carboxylic methyl cellulose[9] | 0.86 | 0.86 | 0.86 | 0.86 | 0.86 | 0.86 |
| Styrene acrylate latex[10] | 15 | 15 | 15 | 15 | 15 | 15 |
| Optical brightener[11] | 1 | 1 | 1 | 1 | 1 | 1 |
| Curing agent[12] | 0.7 | 0.7 | 0.7 | 0.7 | 0.7 | 0.7 |
| Dry matter content (%) | 64.0 | 63.6 | 63.8 | 63.6 | 64.0 | 50.2 |
| pH | 8.5 | 8.5 | 8.5 | 8.5 | 8.5 | 8.5 |
| Viscosity (cP) | 2328 | 3714 | 2634 | 2694 | 2112 | 1170 |
| Temperature (° C.) | 25.5 | 25.0 | 24.0 | 26.5 | 25.0 | 25.5 |

TABLE 2

| surface coating | |
|---|---|
| | Sample 1 |
| $CaCO_3$[13] | 70 |
| Kaolin[2] | 30 |
| Dispersing agent[7] | 0.25 |
| Polyvinyl alcohol[8] | 0.30 |
| Carboxylic methyl cellulose[9] | 0.70 |
| Styrene acrylate latex[10] | 15 |
| Curing agent[12] | 0.60 |
| Optical brightener[11] | 0.35 |
| Calcium stearate[14] | 0.70 |
| Dry matter content | 62.9% |
| pH | 8.4 |
| Viscosity | 1000 cP |

[1]Hydrocarb 90 (HC 90)
[2]Amazon Premium
[3]Opacarb A 40
[4]Kemira AN
[5]Dupont RPS
[6]CoCoat P 80 HB
[7]Polysalz S (Polyacrylic acid)
[8]Mowiol 6-98
[9]Finnfix 30 (FF 30)
[10]Raisional 204
[11]Blankophor
[12]Bacote 20 (Aqueous solution of ammonium zirconium carbonate)
[13]Covercarb 75 (CC 75)
[14]Nopcote C-104

The previously coated samples were visually examined in daylight. Samples 1-5 had a flawless surface, i.e. an evenly bright surface without visible traces of marking. Sample 6, whose coating paste was based on gypsum, had slightly altered marking locations, which was attributed to removal of crystal water during laser irradiation.

As the samples were placed in ultraviolet light, the marks appeared distinctly darker than their environment in samples 1, 3 and 6. By contrast, samples 2, 4 and 5 retained an overall darker shade, which apparently was due to the UV light absorbing effect of the pigments used. Optical brighteners have a less brightening action on such inherently bright pigments. By contrast, the optical brightener has a substantially brightening action on calcium carbonate (samples 1 and 3), which are particularly used in coating pastes, and the results indicated that the marking method of the invention, based on elimination of the brightener effect, has excellent efficiency in connection with these.

The invention claimed is:

1. A method for marking a material, comprising the steps of:

incorporating an optical brightener in the material, said optical brightener being capable of transforming ultraviolet radiation into visible light, and performing marking by reducing the brightness of the material at a selected location by directing local heating which partially or completely destroys the brightening effect of the optical brightener at this location, wherein the mark thus produced appears with a darker shade than its environment in ultraviolet light.

2. The method of claim 1, wherein marking is performed with a laser beam, whose absorption heat heats the material at the location to be marked.

3. The method of claim 1, wherein marking is performed with a heating element, which is brought into contact with the location of the material to be marked.

4. A method as defined in any of claim 1, 2, or 3, wherein a layered material is marked during its manufacture by making marks in a material layer containing an optical brightener and by applying a second material layer on top of this layer, with the marks remaining within the layer structure produced.

5. The method of claim 1, wherein a paper or board product containing an optical brightener is provided with identifier marks.

6. The method of claim 5, wherein a layered paper or board product is marked by forming marks in an inner material layer of the product containing an optical brightener.

7. The method of claim 6, wherein a precoating layer containing an optical brightener is applied onto a moving paper or board web, the precoating layer being marked with a laser beam, and a surface coating is applied onto the precoated web, the marks being thus protected under the surface coating.

8. The method of claim 7, wherein precoating and surface coating and also laser marking between the coating steps are performed on a web in continuous movement in a paper or board machine.

9. The method of claim 6, wherein the optical brightener is incorporated in a fibre layer of paper or board produced as a continuous web, which is marked by a laser beam, and the moving web is subsequently coated with one or more coating layers covering the marks.

10. The method of claim 6, wherein a surface coating containing an optical brightener is applied onto a moving web, the surface coating being marked with a laser beam, and the surface-coated web is coated with a polymer coating such that the marks in the surface coating are protected under the polymer layer.

11. A method for verifying the genuineness of a product, which comprises the steps of:

incorporating in the product a material, in which an optical brightener has been dispersed and which has been marked by reducing its brightness at a selected location by directing local heating which partially or completely destroys the brightening effect of the optical brightener at this location, and placing the product in ultraviolet light in order to expose the identifier mark.

12. The method of claim 11, wherein the identifier mark is provided in a paper or board containing an optical brightener and used in a product package.

13. The method of claim 12, wherein said optical brightener is Blankophor.

14. The method of claim 1, wherein said optical brightener is Blankophor.

15. The method of claim 3, wherein said heating element is a heated roll equipped with relief patterns corresponding to the marks.

* * * * *